United States Patent [19]

Hornbuckle

[11] 4,369,959

[45] Jan. 25, 1983

[54] SHEET FEED MACHINE

[76] Inventor: William M. Hornbuckle, 7080 Stonington Dr., NE., Atlanta, Ga. 30328

[21] Appl. No.: 267,008

[22] Filed: May 26, 1981

Related U.S. Application Data

[63] Continuation of Ser. No. 93,305, Nov. 10, 1979, abandoned, which is a continuation of Ser. No. 891,018, Mar. 28, 1978, abandoned.

[51] Int. Cl.[3] ..... B65H 1/30; B65H 1/04; B65H 3/04

[52] U.S. Cl. ..... 271/3.1; 271/6; 271/31; 271/35; 271/151; 271/164; 271/212; 271/274

[58] Field of Search ..... 271/3.1, 6, 7, 35, 34, 271/151, 198, 275, 274, 273, 272, 216, 212, 124, 171, 223, 164, 37, 38, 30 R, 31; 198/423, 452, 462

[56] References Cited

U.S. PATENT DOCUMENTS

| | | | |
|---|---|---|---|
| 584,435 | 6/1897 | Wash | 271/35 X |
| 1,593,563 | 7/1926 | Blaine | 271/164 |
| 2,097,013 | 10/1937 | Bartholdt | 271/37 |
| 2,926,907 | 3/1960 | Bromberg | 271/35 |
| 3,122,233 | 2/1964 | Novick | 271/274 X |
| 3,322,602 | 5/1967 | Schneider | 271/35 |
| 3,345,064 | 10/1967 | Vandenberg | 271/212 |
| 3,945,633 | 3/1976 | Knopp | 271/3.1 |
| 3,984,659 | 10/1976 | Bilbrey | 271/35 X |
| 3,998,451 | 12/1976 | McInerny | 271/212 |

FOREIGN PATENT DOCUMENTS

| | | | |
|---|---|---|---|
| 7701040 | 9/1977 | Netherlands | 198/453 |

*Primary Examiner*—Bruce H. Stoner, Jr.
*Attorney, Agent, or Firm*—Newton, Hopkins & Ormsby

[57] ABSTRACT

A sheet feed machine comprising guides for holding sheets in a stack at a sheet input station, a first conveyor for successively feeding sheets from the bottom of the stack at the sheet input station into a stream with adjacent sheets in an overlapped configuration, and an inverter for inverting the stream of sheets at a sheet inversion station. A stop is located at a sheet output station for stopping the stream and accumulating sheets in a stack, and a second conveyor is provided for conveying the stream of sheets from the inversion station to the sheet output station.

15 Claims, 3 Drawing Figures

SHEET FEED MACHINE

CROSS REFERENCE TO RELATED APPLICATION

This application is a continuation of my co-pending application for SHEET FEED MACHINE, Ser. No. 093,305, filed Nov. 10, 1979, now abandoned, which is a continuation of application Ser. No. 891,018, filed Mar. 28, 1978, now abandoned.

BACKGROUND OF THE INVENTION

This invention relates generally to sheet feed machines, and particularly to the type of machines which feed sheets from the bottom of a stack successively into an ancillary machine such as a printer for processing.

There are many types of machines and printers that successively process individual sheets of materials such as envelopes, book pages, pamphlets and the like. The sheets are individually fed into the printer from a stack as by the use of suction cups which descend atop the uppermost member of the stack at an input feed station and lift the uppermost member off and into the printer. The sheet material may be manually replaced with a successive stack once the stack at the printer input feed station is exhausted. Such manual replacement of material, however, requires that the printer itself be momentarily shut down and the sheet gripping mechanism moved aside during stack replenishing. This intermittent halting and restarting of printing operations has the obvious disadvantage of limiting the speed at which the sheet material may be printed.

To overcome the just mentioned problem sheet feed machines have heretofore been devised which may be connected to the input feed station of a printing machine. The main function of the sheet input machine is to provide a place in which stacks of sheet material may be replenished without interrupting the operation of the printer. With these sheet feed machines the lowermost sheets are successively stripped from the bottom of the stack and fed into the printer input station.

Unfortunately, the just described sheet feed machines have possessed limitations and persistent problems. Foremost among these has been the difficulty encountered in coordinating or timing the speed at which the sheet feed machine operates with that at which the printer itself operates. Slight mismatches in timing present errors which are cumulative over periods of time which can quickly lead to erroneous printing. In addition, these sheet feeders have lacked versatility with regard to material handling capability. In those case where sheets have been fed with adjacent sheets in a mutually overlapped condition the machines have tended to vary the degree of overlap beyond acceptable limits. In addition, even where the initial overlap and speed has been correct the machine has experienced difficulty in maintaining proper spacing along the path at which they are conveyed to the printer. The time and difficulty encountered in correctly attaching the feeder to the printers has also been substantial.

Accordingly, it is a general object of the present invention to provide an improved sheet feed machine.

More specifically, it is an object of the present invention to provide a sheet feed machine whose speed of operations does not have to be closely timed with that of an ancillary sheet processing machine which it serves.

Another object of the invention is to provide a sheet feed machine of the type described with improved means for stripping sheets from the bottom of the stack of sheets with adjacent stripped sheets in a mutually overlapped configuration.

Yet another object of the invention is to provide the sheet feed machine of the type described with improved means for holding a stream of sheets in relative position one to another as they are being fed.

Still another object of the invention is to provide a sheet feed machine that may be quickly and easily attached to the sheet processing machine which it serves.

SUMMARY OF THE INVENTION

In one preferred form of the invention a sheet feed machine is provided which comprises means for holding sheets in a stack at a sheet input station, first conveyor means for successively feeding sheets from the bottom of a stack at the sheet input station into a stream of sheets with adjacent sheets positioned in an overlapped configuration, and means for inverting the stream of sheets at a sheet inversion station. Stop means are located at a sheet output station for stopping the stream and accumulating the sheets into a second stack. Second conveyor means are provided for conveying the stream of sheets from the inversion station to the sheet output station.

In another form of the invention a mechanism is provided in a sheet feed machine for stream feeding sheets from a stack with adjacent sheets fed in an overlapped configuration. The mechanism comprises an upper roller mounted for rotation about an upper axis, a lower roller mounted for rotation about a lower axis located parallel with and to one side of and below the upper axis, and an intermediate roller mounted for rotation about an intermediate axis located parallel with the upper axis and offset above a plane passing through the upper and lower axes. A conveyor belt extends over the upper, intermediate and lower rollers. The mechanism also includes means for driving the conveyor belt and means for holding sheets in a stack upon the belt between the intermediate and lower rollers with a portion of the stack located above the belt between the intermediate and upper rollers.

In yet another form of the invention a mechanism is provided in a sheet feed machine for holding a stream of sheets moving atop a conveyor belt in position relative one to the other. The mechanism comprises a beam pivotably mounted above the conveyor belt, a first collar mounted to the beam, and at least one roller rotatably suspended from the first collar over the belt. A second collar is mounted to the beam in spaced relation with the first collar and at least one other roller is suspended from the second collar. The mechanism also includes means for adjusting the spacing between the collars upon the beam to accommodate variations in feed sheet sizes and spacings of the sheets in the stream.

DESCRIPTION OF THE PREFERRED EMBODIMENTS

Figure 1:
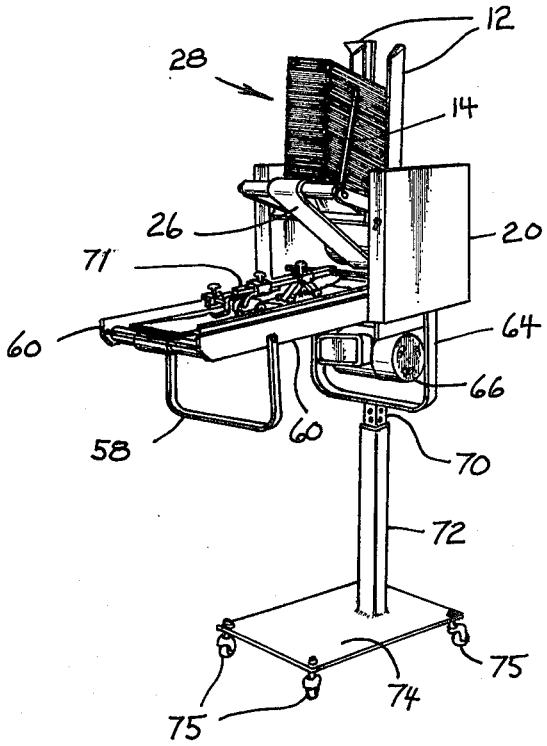
FIG. 1 is a perspective view of a sheet feed machine embodying principles of the invention in one preferred form.
Figure 2:
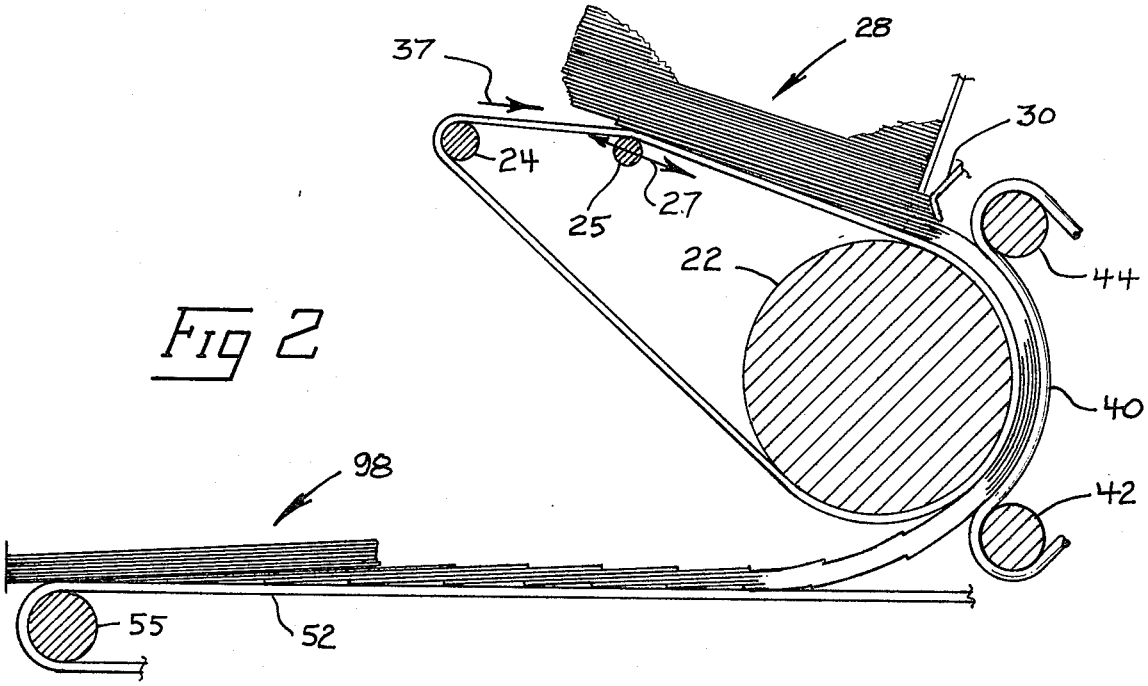
FIG. 2 is a side elevational view, partly in cross-section, of a portion of the machine shown in FIG. 1.

Referring now in more detail to the drawing, there is shown a sheet feed machine for feeding sheets to a printer 10 such as a duplicator Model No. 350 sold by the A. B. Dick Company. The sheet feed machine is seen to include a pair of angle iron guide plates 12 and a pair of upright guide pins 14 located upon mutually parallel inclines. The guide pins are mounted by wing nuts 16 to a pair of rails 18 which are in turn mounted to the inside of parallel side frame members 20. A main feed cylinder 22 is rotatably mounted between frames 20 beneath the guide plates 12. An idler roller 24 is rotatably mounted between the rails above and to one side of the main feed roller 22. An apex roller 25 is rotatably mounted to the side frames above a plane which passes between the axes of rollers 22 and 24. The location of the apex roller is adjustable atop rails 18 along plane 27 shown in FIG. 2 for the purpose hereinafter described.

An endless belt 26 is seen to be looped over the three rollers 22, 24 and 25. A stack of envelopes 28 is shown set atop that portion of the belt located between rollers 22 and 25 with a portion overhanging that portion of the belt located between rollers 24 and 25. A lower edge of the stack is supported upon and between the guide plates 12 between the guide pins 14. A retainer plate 30 is mounted to a bar 32 that extends between the two side frame members 20 with a lower lip portion resting upon a bar rest 34 just behind the guide plates 12 and just above belt 26. The retainer plate is biased downwardly by a compression spring 35 held atop a retainer plate upper-flange by a knurled screw 36.

The just described mechanism serves to feed envelopes successively from the bottom of stack 28 into a stream of envelopes with adjacent envelopes overlapped. This may be best visualized in FIG. 2 by following the travel of belt 26 as it passes from idler 24 in the direction of arrow 37 towards and then over the apex roller 25. Initial movement of the belt urges the bottom-most envelope to be stripped from the stack downwardly beneath the retainer plate lower lip until the trailing edge of the envelope distal the guides 12 has passed over the apex roller 25. As this trailing edge passes over the apex roller 25 the next portion of the belt 26 itself to pass over the apex roller 25 will follow and thus fail to engage the bottom-most envelope but instead engage the envelope immediately thereabove. At this point there will be seen that an overlap gap has been created which approximates the distance between the apex roller 25 and the edge of the stack distal the guides 12. Thus, slight relocations of the apex roller can effect charges in the overlap gap thereby altering the speed of operations. Continued movement of the belt successively causes a stripping of envelopes from the bottom of the stack in a mutually overlapped configuration. In this manner several layers of envelopes will simultaneously be caused to pass beneath the retainer plate 30. That the retainer plate 30 is spring biased in a downward direction provides an adjustment means by manual rotation of the knurled screw 36 in finely adjusting the just described operation.

After the sheets have left the sheet input station and passed beneath the retainer plate lower lip 32, they are routed around under the main feed cylinder 22 at the sheet inversion station. This is accomplished by the simultaneous actions of conveyor belt 26 as it moves about the main feed cylinder and another conveyor belt 40 which is routed over a drive roller 42, an idler 44 and a tension adjust roller 45. As a portion of the main feed cylinder 22 lies in a plane passing tangentially over rollers 42 and 44, belt 40 is seen to curve inwardly as it passes over the main feed cylinder. The velocity of the drive roller 42 is set to cause the conveyor belt 40 to move at the same speed as the conveyor belt 26 does over the main feed cylinder 22. It thus is seen that with a stream of envelopes carried atop belt 26 they will be sandwiched between belts 26 and 40 as they are conveyed down and around the main feed cylinder 22. In this manner it is seen that the stream of envelopes is inverted.

Figure 3:
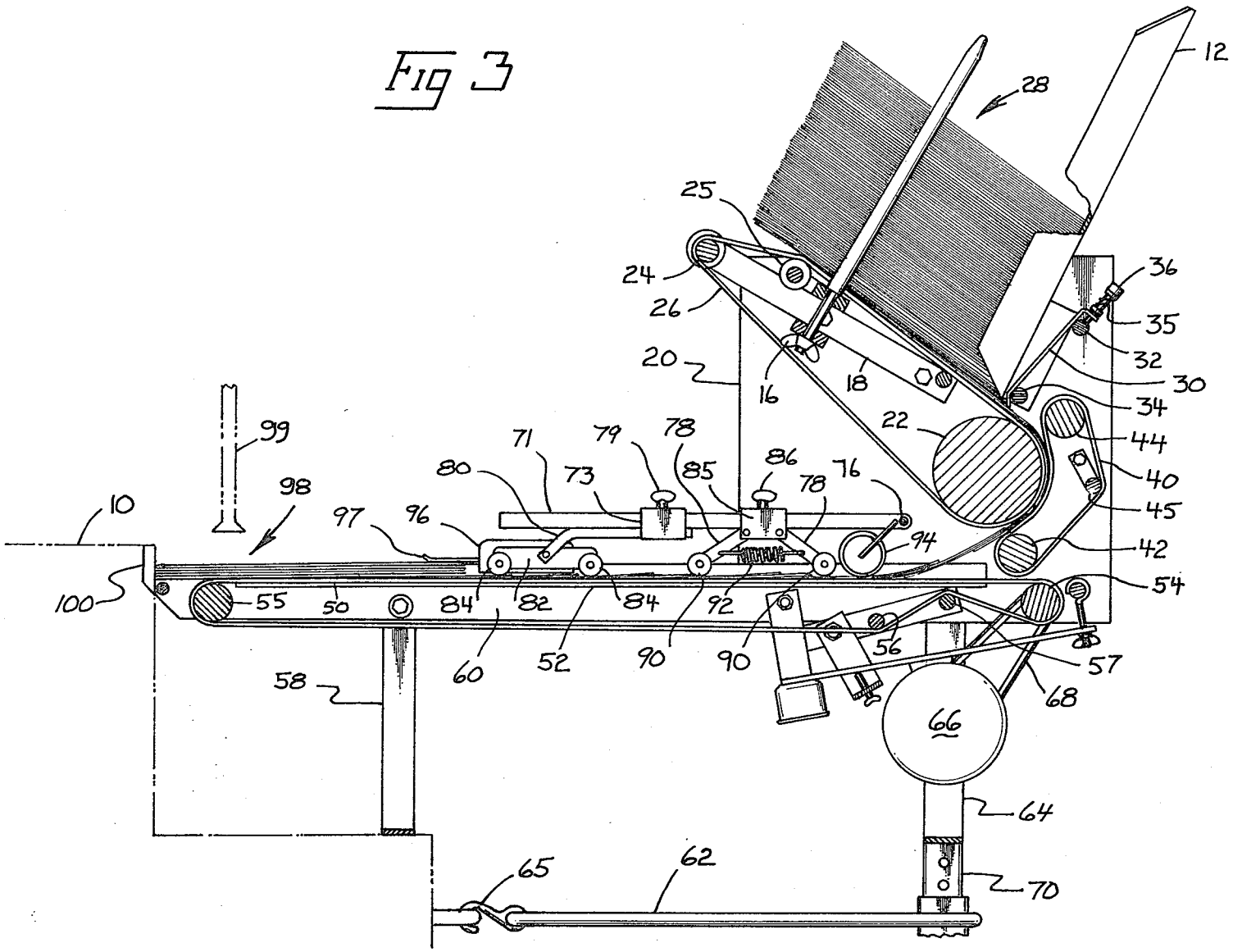
FIG. 3 is a side elevational view, partly in cross-section, of the sheet feed machine pictured in FIG. 1.

After the stream of sheets has been inverted it is guided onto a horizontal feeder tray 50 over which another endless conveyor belt 52 is driven as shown in FIG. 3. This conveyor belt 52 is routed over a drive shaft 54, a front idler 55 and a pair of tension rollers 56 and 57. A U-shaped leg 58 is pivotably mounted to parallel frame support 60 to each side of the feeder tray which leg is sized to be placed atop the printer elevator. An electric motor 66 is mounted between another U-shaped leg 64 having its output drive shaft coupled with a drive belt 68 that drives shaft 54. Unshown endless chains in turn couple the main drive shaft with the other drive cylinder 22 and roller 42 for driving belts 26 and 40 while the main drive shaft itself drives the conveyor belt 52. The U-shaped leg 64 is mounted atop a stanchion 70 which is telescopically received within another stanchion 72 that extends uprightly from a platform 74 supported upon a floor by a set of casters 75. This telescoping arrangement of the stanchion enables the height of the sheet feed machine to be adjusted. This height adjustable feature, coupled with the pivotably U-shaped front leg 58 and strap 62, enable the sheet feed machine to be readily connected with numerous sheet processing machines such as printers in a minimum of time and with a minimum of effort and training.

The sheet feed machine also includes a mechanism for holding the stream of sheets down upon the top of the conveyor belt 52 with adjacent sheets in the stream maintained in mutual relative position. This hold-down mechanism includes a beam 71 pivotably mounted by pivot pin 76 above the conveyor belt 52. A collar 73 is slideably mounted by set screw 79 to the beam which collar supports a trolley arm 80 to which a trolley 82 is pivoted. The trolley in turn supports a pair of mutually spaced rollers 84. Another collar 85 is slideably mounted by a screw 86 to the beam. A pair of legs 78 is pivotably mounted to this collar 85 with each leg supporting a roller 90. A tension spring 92 couples the two legs 78 together. Finally, a rear wheel 94 is pivotably mounted to the beam closely adjacent to the pivot pin 76. With this hold-down arrangement the members in a stream of sheets passing atop belt 52 and tray 50 are held in firm engagement atop the belt 52 with relative movement between the members in the stream inhibited. It will also be seen that the collars 73 and 85 enable the spacing of the various rollers of the hold-down mechanism to be altered to accommodate variations in sheet sizes and overlap spacings. The rear most roller 94 is purely optional, being preferred only for very small envelopes.

Finally, the sheet feed machine is seen to include a microswitch 96 to which an actuating arm 97 is mounted. The microswitch 96 serves to terminate, through unshown electrical circuitry, the operation of the electric motor 66 in driving the various conveyor belts 26, 40 and 52 when a stack 98 of sheets has been accumulated beneath a suction pickup arm 99 of the printer or other sheet processing machine. Once this actuating arm 97 has fallen from the removal of sheets from the stack faster than they are being resupplied, motor 66 is reactivated to feed additional sheets into the pickup station. The sheets are accumulated here by the provisions of stop 100.

It should be understood that the just described embodiments merely illustrates principles of the invention in preferred forms. Many modifications, additions and deletions may, of course, be made thereto without departure from the spirit and scope of the invention as set forth in the following claims.

What is claimed is:

1. An improved sheet material processing apparatus for feeding successive sheets of said sheet material to a printer of the type having a suction arm over a printer elevator of said printer, said suction arm removing successive top sheets from a stack of sheets therebelow, said apparatus comprising, in combination:

(a) a portable self contained frame supporting structure including an upstanding stanchion member with its lower end adapted to be supported on the floor which supports said printer, a frame having an input end and an output end, said frame being mounted to the upper end of said stanchion member by its input end, said frame protruding in cantilever fashion from said stanchion member, said stanchion member supporting said frame at a height such that the output end will protrude into a position vertically between said elevator and said suction arm and said input end is vertically outwardly of said printer when said stanchion member is positioned on the floor adjacent to the end of said printer;

(b) a sheet material input station spaced from said output end and mounted on said input end of said frame, with said input station detailed to permit sheet material being processed to be successively added to one portion of said input station while being simultaneously removed from another portion of said station;

(c) a sheet material output station mounted on said output end of said frame, with said output station detailed to permit sheet material being processed to produce a stack of sheets such sheet material at said output station and below said suction arm and also to permit successive sheets of said sheet material to be progressively fed to the bottom of the stack of sheets of sheet material and for permitting said suction arm to successively remove the topmost sheet from said stack of sheet material at said output station while sheets of said sheet material are being simultaneously added to the bottom of said stack in said output station;

(d) sheet material transfer means supported on said frame and operable for effecting a transfer of sheets of said sheet material from said other portion of said input station to said output station for progressively replenishing said stack;

(e) control means on said frame structure operable for sensing a predetermined accumulation of sheets of said sheet material in said output station and operable for initiating operation of said transfer means when the sheet accumulation in said stack drops below a predetermined amount and stopping operation of said transfer means in response to the accumulation of a predetermined amount; and (f) means for removeably securing said apparatus to the end of said printer in a position in which said output station is disposed below said suction arm and over said printer elevator.

2. An improved sheet material processing apparatus as defined in claim 1 further characterized in that said input station and said output station includes adjustment means to permit various thickness sheet material to be processed.

3. An improved sheet material processing apparatus as defined in claim 1, further characterized in that said transfer means includes a conveyor system detailed for successively removing sheet material from the bottom of a stack in said input station, inverting said sheet material, and delivering said sheet material to the bottom of a stack in said output station.

4. An improved sheet material processing apparatus as defined in claim 3 further characterized in that said conveyor system is detailed to transfer said sheet material from said input station to said output station in a stream of sheets with adjacent sheets positioned in an overlapped configuration.

5. An improved sheet material processing apparatus as defined in claim 1 further characterized in that said apparatus includes an independent power means for effecting operation of said transfer means.

6. A sheet feed machine for positioning sheets in a position to be received by a printer comprising:

(a) a platform;

(b) an upstanding external stanchion assembly secured by its lower end to said platform;

(c) a frame carried by the upper end portion of said stanchion assembly, said frame having a sheet material input portion above said stanchion assembly and a sheet material output portion connected by its inner end to the upper end portion of said stanchion assembly, said output portion protruding in cantilever fashion from said stanchion assembly over said platform, the outer end portion of said output portion being of a height to extend over the end portion of said printer;

(d) a front leg extending downwardly from the outer end portion of said output portion for being received by its lower end portion on said printer;

(e) said sheet material input portion having an endless feed belt with an upper flight and a lower flight, roller means for supporting and driving said feed belt, a generally upright retaining plate carried by said frame for maintaining a plurality of sheets in a stack over the upper flight of said feed belt, the lower end portion of said plate terminating immediately above the upper flight of said belt in spaced relationship thereto, means for moving said plate toward and away from said belt to vary the space between said belt and lower end of said plate for enabling said belt to feed said sheets successively from the bottom portion of the stack, and a second endless belt having an inner portion tangentially around the end portion of said feed belt and around a portion of one of its roller means for guiding said sheets successively around the end portion of said feed belt;

(f) a third endless belt carried by said frame in said output portion and having an upper flight disposed generally horizontally with its inner end below said feed belt for receiving said sheets from said feed belt and for moving said sheets toward the outer end of said third belt; and (g) control means for sensing an accumulation of said sheets on said belt for stopping the operation of the aforesaid belts.

7. The sheet feed machine defined in claim 6 wherein said stanchion assembly includes a telescoping stanchion for varying the height of said frame.

8. The improved sheet material processing apparatus defined in claim 1 including support means carried by said output end of said frame for being received on said printer elevator when said output end is positioned below said suction arm and above said printer elevator so that the output end of said frame is supported by said printer elevator.

9. The improved sheet material processing apparatus defined in claim 8 wherein said support means includes a U-shaped leg mounted by its ends to said frame, said U-shaped leg protruding downwardly from said frame and terminating below said frame for being received by its lowermost portion on said printer elevator.

10. The improved sheet material processing apparatus defined in claim 9 wherein said ends of said legs are pivotally mounted to said frame.

11. The improved sheet material processing apparatus defined in claim 1 wherein said means for removeably securing said apparatus to the end of said printer includes a strap for extending from said upright stanchion member to the end of said printer.

12. The improved sheet material processing apparatus defined in claim 1 wherein said stanchion member is adjustable vertically for adjusting the height of said frame.

13. The improved sheet material processing apparatus defined in claim 12 including a leg spaced laterally from said stanchion member, said leg extending downwardly from and being pivotally carried by said output end of said frame.

14. The improved sheet material processing apparatus defined in claim 1 including a leg extending downwardly from the output end of said frame, said leg being spaced from and being shorter than said stanchion member, whereby when said leg is resting upon said printer elevator and said stanchion member is on the floor adjacent to said printer, the frame is supported by said stanchion member and said leg in about a horizontal position.

15. The improved sheet material processing apparatus defined in claim 1 wherein said sheet material transfer means includes a roller carried by said frame at the output end of said frame, a second roller carried by said frame at the input end of said frame, an endless belt carried by said rollers, said endless belt having an upper flight and a lower flight, and a stop on said frame adjacent to the end of said upper flight and on said output end of said frame for operating with said upper flight for forming said stack in said output station and on said upper flight at said output station.

* * * * *